US008890751B2

(12) United States Patent
Wolf et al.

(10) Patent No.: US 8,890,751 B2
(45) Date of Patent: Nov. 18, 2014

(54) ANTENNA HAVING A PLANAR CONDUCTING ELEMENT WITH FIRST AND SECOND END PORTIONS SEPARATED BY A NON-CONDUCTIVE GAP

(75) Inventors: Forrest D. Wolf, Reno, NV (US); Claude Jean Michel Laurent, Aalborg (DK)

(73) Assignee: Pinyon Technologies, Inc., Reno, NV (US)

( * ) Notice: Subject to any disclaimer, the term of this patent is extended or adjusted under 35 U.S.C. 154(b) by 69 days.

(21) Appl. No.: 13/434,594

(22) Filed: Mar. 29, 2012

(65) Prior Publication Data

US 2013/0214985 A1 Aug. 22, 2013

Related U.S. Application Data

(60) Provisional application No. 61/599,932, filed on Feb. 17, 2012.

(51) Int. Cl.
*H01Q 1/38* (2006.01)

(52) U.S. Cl.
USPC ..... 343/700 MS

(58) Field of Classification Search
CPC ..... H01Q 7/00; H01Q 1/38
USPC ..... 343/700 MS, 741, 866
See application file for complete search history.

(56) References Cited

U.S. PATENT DOCUMENTS

| | | | | |
|---|---|---|---|---|
| 5,300,936 | A | 4/1994 | Izadian | |
| 6,018,324 | A | 1/2000 | Kitchener | |
| 6,917,335 | B2 * | 7/2005 | Kadambi et al. | 343/700 MS |
| 6,973,716 | B2 | 12/2005 | Chung et al. | |
| 7,202,830 | B1 | 4/2007 | Brown et al. | |
| 7,522,114 | B2 | 4/2009 | Brown et al. | |
| 7,839,339 | B2 * | 11/2010 | Phillips et al. | 343/700 MS |
| 7,999,751 | B2 * | 8/2011 | Iliev et al. | 343/788 |
| 8,164,528 | B2 * | 4/2012 | Brown | 343/728 |
| 8,462,061 | B2 * | 6/2013 | Brown | 343/725 |
| 8,462,070 | B2 | 6/2013 | Wolf | |
| 2011/0049249 | A1 | 3/2011 | Kato et al. | |
| 2011/0241944 | A1 | 10/2011 | Wolf et al. | |
| 2011/0273337 | A1 | 11/2011 | Wolf | |
| 2013/0141301 | A1 * | 6/2013 | Liu | 343/848 |

FOREIGN PATENT DOCUMENTS

| | | | |
|---|---|---|---|
| JP | 09-260935 | A | 10/1997 |
| KR | 10-2011-0002820 | A | 1/2011 |

OTHER PUBLICATIONS

International Search Report and Written Opinion dated Jun. 26, 2013 for PCT/US2013/026602, 12 pages.

* cited by examiner

*Primary Examiner* — Hoang V Nguyen
(74) *Attorney, Agent, or Firm* — Holland & Hart LLP

(57) ABSTRACT

In one embodiment, an antenna includes a dielectric material and a planar conducting element. The dielectric material has a first side opposite a second side, with the planar conducting element residing on the first side. The planar conducting element defines a conductive path between first and second end portions of the planar conducting element, which end portions are separated by a non-conductive gap. In another embodiment, an antenna has a planar conducting element defining a conductive path between first and second end portions of the planar conducting element. The planar conducting element has at least two different widths transverse to the conductive path. The first and second end portions of the planar conducting element are separated by a non-conductive gap.

5 Claims, 15 Drawing Sheets

ANTENNA HAVING A PLANAR CONDUCTING ELEMENT WITH FIRST AND SECOND END PORTIONS SEPARATED BY A NON-CONDUCTIVE GAP

CROSS-REFERENCE TO RELATED APPLICATIONS

This application claims the benefit of U.S. patent application Ser. No. 61/599,932 filed Feb. 17, 2012, which is hereby incorporated by reference for all that it discloses.

BACKGROUND

The acceptance and use of wireless devices is growing at a staggering pace. So too are the number and types of wireless devices growing. Wireless devices range from mobile phones, mobile computers, wireless routers, and wireless access points to desktop computers, home automation systems, surveillance systems, and health monitoring devices. With this growth in the number, types, and use of wireless devices, the number of communication protocols and transmission frequencies used by wireless devices has also increased. Still further, the number of applications and settings in which wireless devices are used has increased. All of these factors contribute to a need for new and better types of antennas, and for antenna designs that can be easily tuned for use with different types of devices, different communication protocols, and different applications and settings.

SUMMARY

In one embodiment, an antenna comprises a dielectric material and a planar conducting element. The dielectric material has a first side opposite a second side, with the planar conducting element residing on the first side. The planar conducting element defines a conductive path between first and second end portions of the planar conducting element, which end portions are separated by a non-conductive gap.

In another embodiment, an antenna has a planar conducting element defining a conductive path between first and second end portions of the planar conducting element. The planar conducting element has at least two different widths transverse to the conductive path. The first and second end portions of the planar conducting element are separated by a non-conductive gap.

Other embodiments are also disclosed.

BRIEF DESCRIPTION OF THE DRAWINGS

Illustrative embodiments of the invention are illustrated in the drawings, in which.

In the drawings, like reference numbers in different figures are used to indicate the existence of like (or similar) elements in different figures.

DETAILED DESCRIPTION

Figure 1:
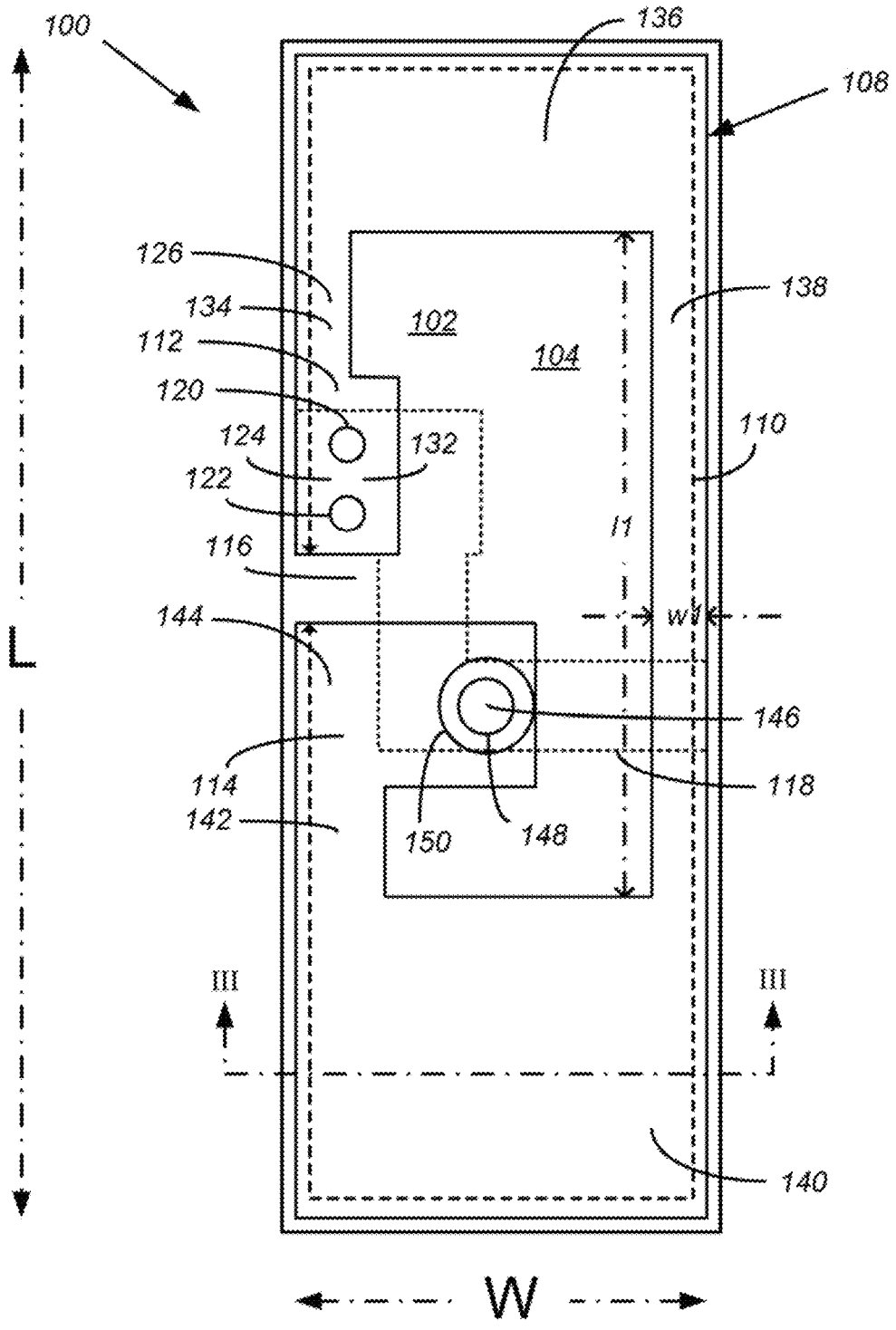
FIGS. 1-3 illustrate a first exemplary embodiment of an antenna having a planar conducting element, wherein the planar conducting element defines a conductive path between first and second end portions separated by a non-conductive gap.
Figure 2:
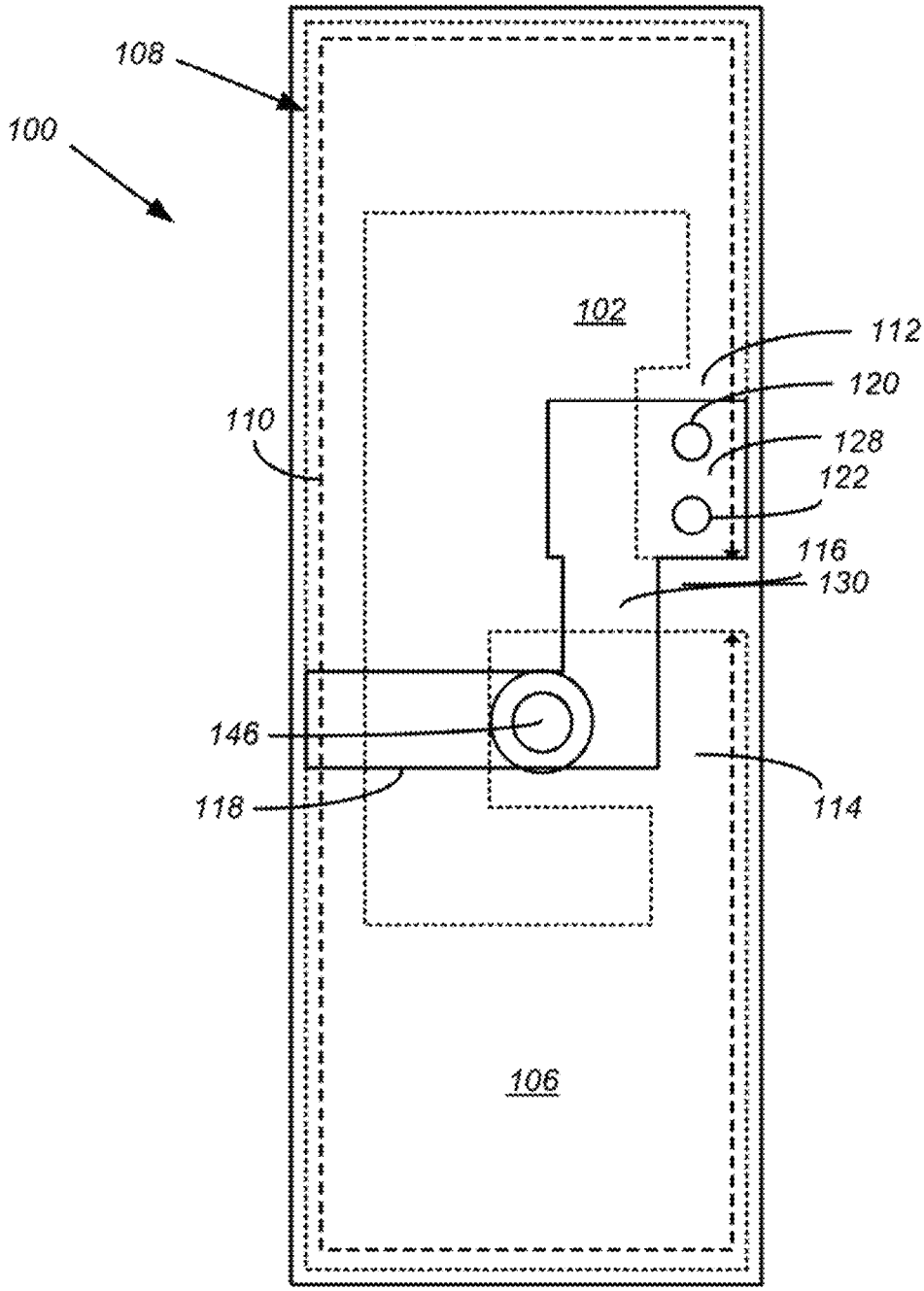
Figure 3:
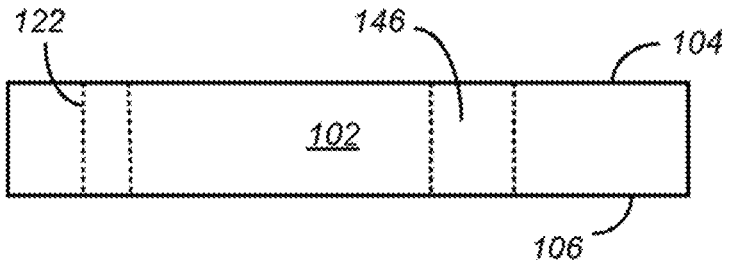

FIGS. 1-3 illustrate a first exemplary embodiment of an antenna 100. The antenna 100 comprises a dielectric material 102 having a first side 104 and a second side 106 (see FIG. 3). The second side 106 is opposite the first side 104. By way of example, the dielectric material 102 may be formed of (or may comprise) FR4, plastic, glass, ceramic, or composite materials such as those containing silica or hydrocarbon. The thickness of the dielectric material 102 may vary, but in some embodiments is equal to (or about equal to) 0.060" (1.524 millimeters).

A planar conducting element 108 (FIG. 1) is disposed on the first side 104 of the dielectric material 102. The planar conducting element 108 defines a conductive path 110 between first and second end portions 112, 114 of the planar conducting element 108. The first and second end portions 112, 114 are separated by a non-conductive gap 116. By way of example, the planar conducting element 108 may be metallic and formed of (or may comprise) copper, aluminum or gold. In some cases, the planar conducting element 108 may be printed or otherwise formed on the dielectric material 102 using, for example, printed circuit board construction techniques; or, the planar conducting element 108 may be attached to the dielectric material 102 using, for example, an adhesive. The first end portion 112 will typically serve as a signal input/output, and the second end portion 114 will typically serve as a ground connection (e.g., the second end portion 114 will typically be connected to a device ground).

An electrical microstrip feed line 118 (FIG. 2) is disposed on the second side 106 of the dielectric material 102. By way of example, the electrical microstrip feed line 118 may be printed or otherwise formed on the dielectric material 102 using, for example, printed circuit board construction techniques; or, the electrical microstrip feed line may be attached to the dielectric material 102 using, for example, an adhesive.

The dielectric material 102 has a plurality of conductive vias (e.g., vias 120, 122) therein, with each of the conductive vias 120, 122 being positioned proximate others of the conductive vias 120, 122. The first end portion 112 of the planar conducting element 108 and the electrical microstrip feed line 118 are each electrically connected to the plurality of conductive vias 120, 122, and are thereby electrically connected to one another. By way of example, the first end portion 112 of the planar conducting element 108 may include (or be) an enlarged portion 124 to which the plurality of conductive vias 120, 122 are electrically connected (i.e., the portion 124 may be wider than another portion 126 of the conducting element 108 to which the portion 124 connects). Similarly, the microstrip feed line 118 may include an enlarged portion 128 to which the plurality of conductive vias 120, 122 are electrically connected (i.e., the portion 128 may be wider than another portion 130 of the microstrip feed line 118 to which the portion 128 connects). Alternately, the portion 128 could be replaced with a conductive pad. In other embodiments, one or both of the portions 124, 128 need not be any wider than the portions 126, 130 to which they respectively connect. In some cases, the enlarged portions 124, 128 enable the planar conducting element 108 and microstrip feed line 118 to be connected using more conductive vias 120, 122. The use of more conductive vias 120, 122 typically improves current flow between the electrical microstrip feed line 118 and the planar conducting element 108, which increased current flow is typically associated with improved power handling capability.

As best shown in FIG. 2, the electrical microstrip feed line 118 has a route that changes direction under the planar conducting element 108. More specifically, the route extends from the plurality of conductive vias 120, 122, to across the non-conductive gap 116 (that is, the route crosses the gap 116), to under the second end portion 114 of the planar conducting element 108. The electrical microstrip feed line 118 may terminate at or about a through-hole 146 at or near the second end portion 114 of the planar conducting element 108 (not shown) or may extend to off or near an edge of the dielectric material 102 (as shown).

The planar conducting element 108 may comprise a plurality of segments. The segments may have different orientations, lengths, widths shapes or other features. By way of example, the planar conducting element 108 is shown to have seven segments 132, 134, 136, 138, 140, 142, 144—each of which intersects or abuts another one of the segments at a right angle. In other embodiments, the planar conducting element 108 could have any number of three or more segments.

Each of the segments 132-144 is shown to have a rectangular shape and has dimensions including a length extending in the direction of the conductive path 110, and a width extending transverse to the direction of the conductive path 110. See, for example, the identified length "l1" and width "w1" of the segment 138. Some of the segments 132-144 have lengths or widths that differ from those of other segments 132-144. Collectively, the segments 132-134 define a G-shaped conducting element, albeit one that has a horizontally flipped orientation.

The segments 132-144 and non-conductive gap 116 have a footprint that generally defines a rectangle, with the non-conductive gap 116 being on a long side of the rectangle. As used herein, the term "footprint" is used to refer to an area bounded by the exterior perimeter of one or more objects or elements. The rectangular footprint of the planar conducting element 108 and non-conductive gap 116 has long sides defining a length, L, and short sides defining a width, W. The perimeter of the rectangular footprint is preferably about one wavelength of an intended operating frequency of the antenna 100.

The end portions 110, 112 of the planar conducting element 108 may be variously shaped and sized, and may each comprise one, less than one, or more than one of the segments 132-144. In FIGS. 1 & 2, the first end portion is defined by the segment 132, and the second end portion is defined by the segment 144. Of note, each of the segments 132 and 144 has a width greater than the width of the segment (134 or 142) to which it connects, thus causing the end portions 110, 112 to jut into the interior of the rectangular footprint defined by the planar conducting element 108 and non-conductive gap 116.

An advantage of the antenna 100 over a simple wire loop antenna is that its design can be easily tuned for use with different device types, different communication protocols, and different applications and settings. This may be done, in some cases, by changing the length or width of one or more of the antenna's segments 132-144. The shape of a segment may also be changed, and if desired, segments may be added into, or removed from, the conductive path 110. A simple wire does not provide this sort of tunability. Changes to the lengths, widths, shapes and number of segments can be used, for example, to change the length of the conductive path, the resistance or capacitance of the conductive path, the intended operating frequency of the antenna, or the antenna's bandwidth, elevation or azimuth.

As shown in FIGS. 1 & 2, the antenna 100 may have a through-hole 146 therein. The through-hole 146 is located at or near the second end portion 114 of the planar conducting element 108. The through-hole 146 is defined at least partly by the dielectric material 102. That is, the through-hole 146 extends through the dielectric material 102, from the first side 104 of the dielectric material 102 to the second side 106 of the dielectric material. 102. In some cases, the through-hole 146 may also be defined by its extension through the planar conducting element 108 (e.g., as shown). The portions 148, 150 of the through-hole extending through the dielectric material 102 and planar conducting element 108 may, for example, be concentric and round. The portion 150 of the through-hole extending through the planar conducting element 108 may be larger than the portion 148 of the through-hole 146 extending through the dielectric material 102, thereby exposing the first side 104 of the dielectric material 102 in an area adjacent the portion 148.

Figure 4:
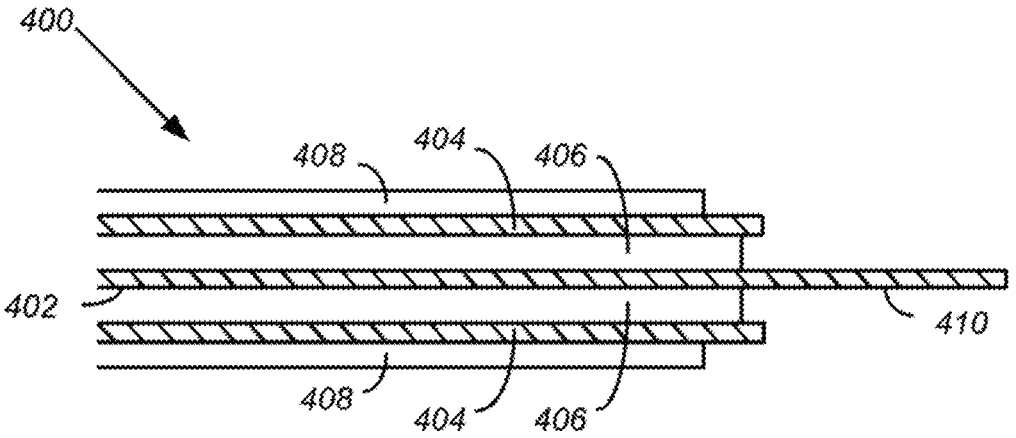
FIG. 4 illustrates a cross-section of a portion of an exemplary coax cable that may be electrically connected to the antenna shown in FIGS. 1-3.
Figure 7:
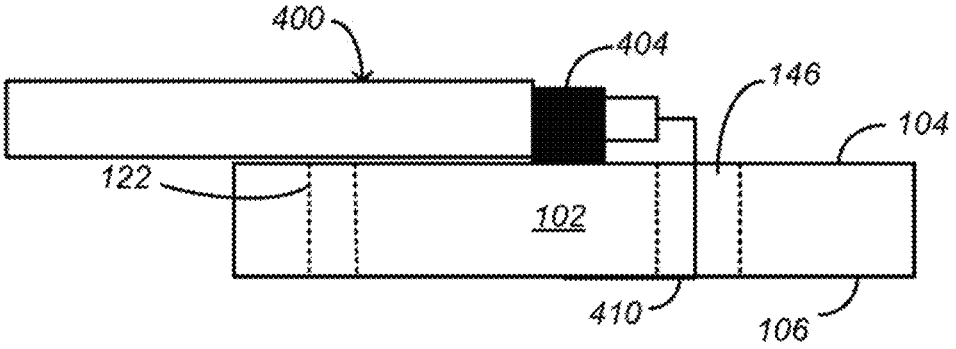
FIGS. 5-7 illustrate an exemplary connection of the coax cable shown in FIG. 410 the antenna shown in FIGS. 1-3.
Figure 5:
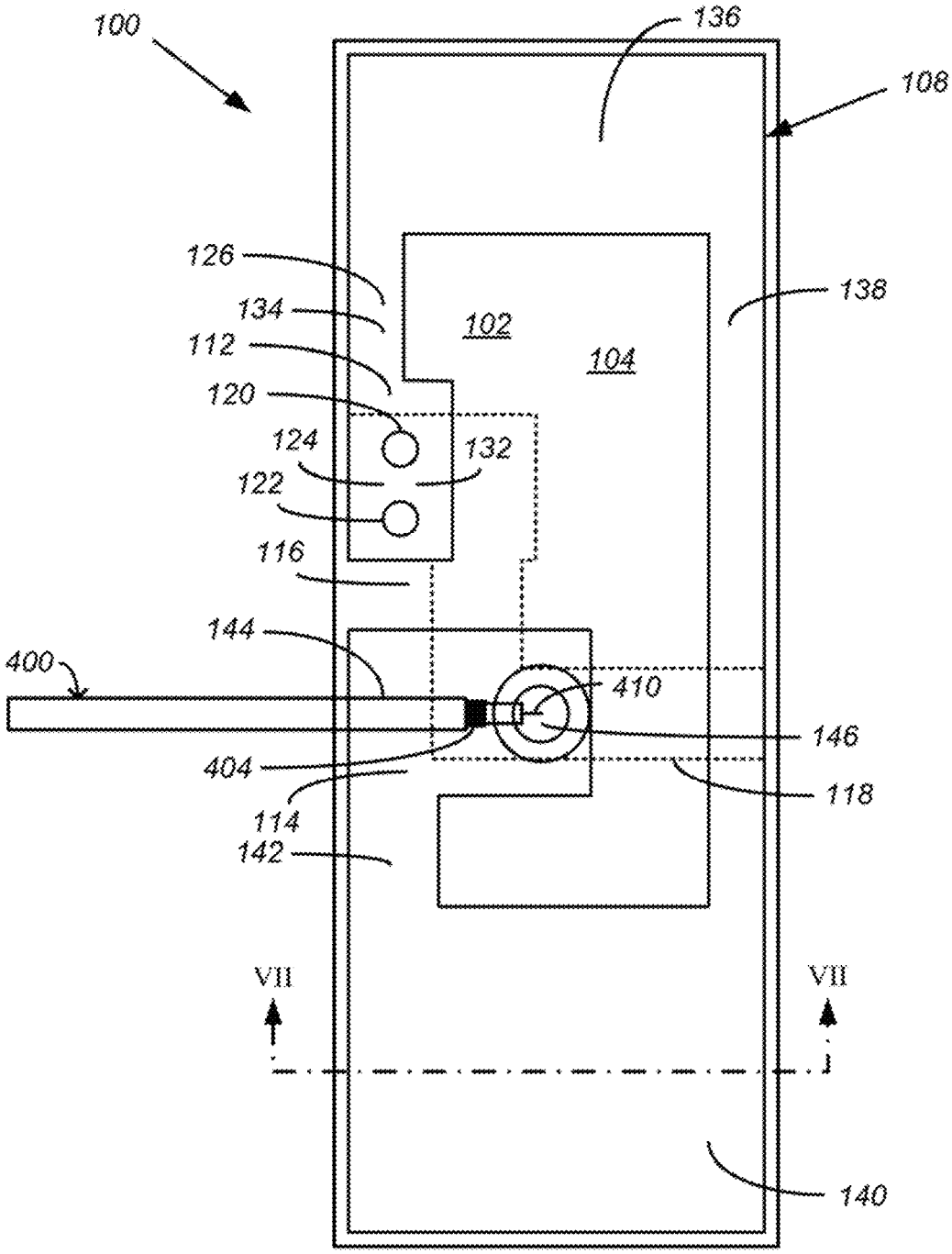
Figure 6:
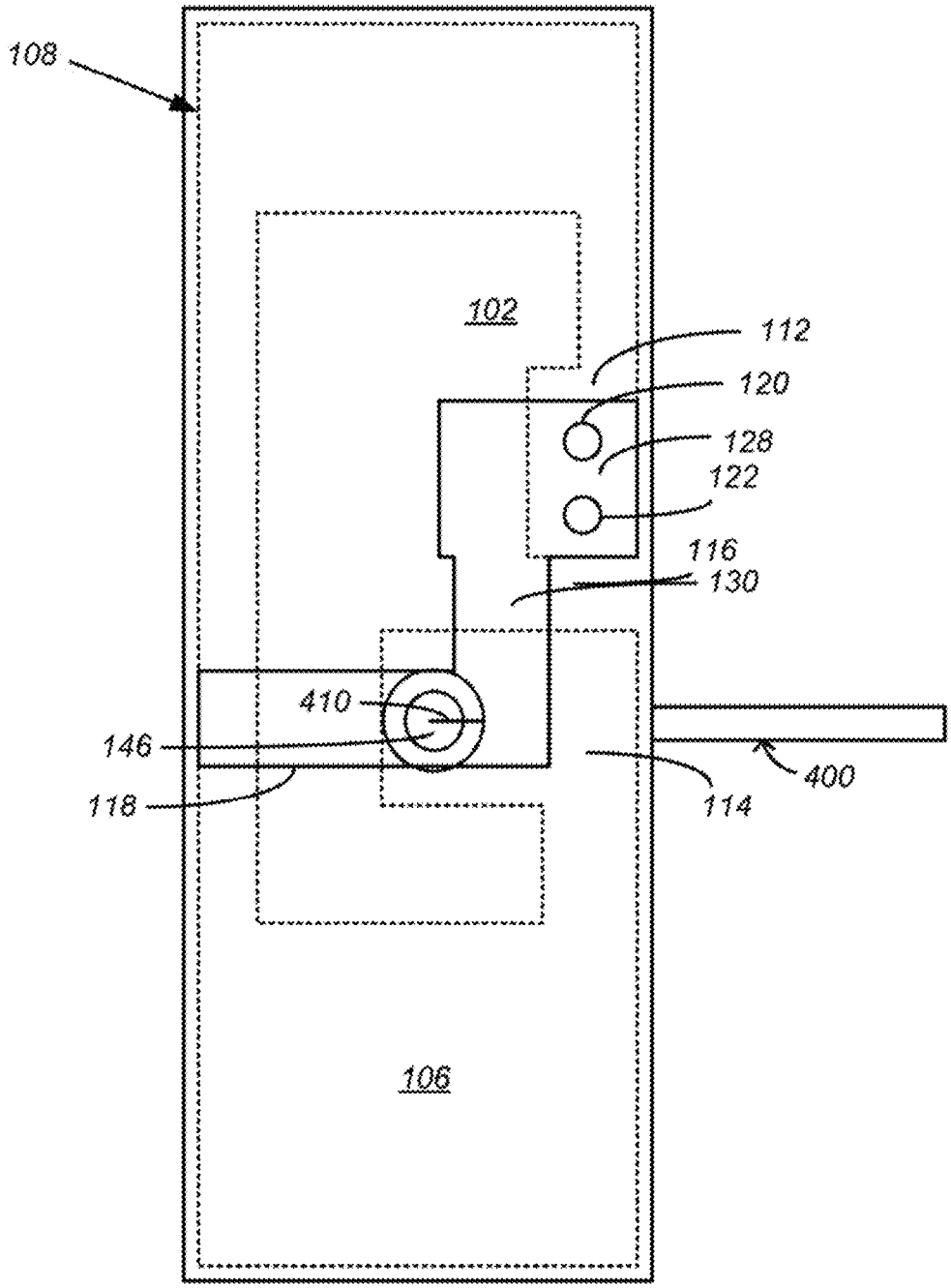

FIG. 4 illustrates a cross-section of a portion of an exemplary coax cable 400 that may be attached to the antenna 100 as shown in FIGS. 5-7. The coax cable 400 (FIG. 4) has a center conductor 402, a conductive sheath 404, and a dielectric 406 that separates the center conductor 402 from the conductive sheath 404. The coax cable 400 may also comprise an outer dielectric jacket 408. A portion 410 of the center conductor 402 extends from the conductive sheath 404 and the dielectric 406. The coax cable 400 is electrically connected to the antenna 100 by positioning the coax cable 400 adjacent the first side 104 of the antenna 100 and inserting the portion 410 of its center conductor 402 through the through-hole 146 (see FIGS. 5 & 7). The center conductor 402 is then electrically connected to the electrical microstrip feed line 118 by, for example, soldering, brazing or conductively bonding the portion 410 of the center conductor 402 to the electrical microstrip feed line 118 (see FIGS. 6 & 7). The conductive sheath 404 of the coax cable 400 is electrically connected to the second end portion 114 of the planar conducting element 108 (also, for example, by way of soldering, brazing or conductively bonding the conductive sheath 404 to the planar conducting element 108; see FIGS. 5 & 7). The exposed ring of dielectric material 102 adjacent the through-hole 146 in the dielectric material 102 can be useful in that it prevents the center conductor 402 of the coax cable 400 from shorting to the conductive shield 404 of the coax cable 400. In some embodiments, the coax cable 400 may be a 50 Ohm (Ω) coax cable.

The coax cable 400 follows a route over the antenna 100 that is parallel to the width, W, of the planar conducting element 108. The coax cable 400 is urged along this route by the electrical connection of its conductive sheath 404 to the planar conducting element 108, or by the electrical connection of its center conductor 402 to the electrical microstrip feed line 114. In alternate embodiments, and as necessary to tune the antenna 100 for a particular application, the coax cable 400 may be urged along other routes over the antenna 100.

Figure 8:
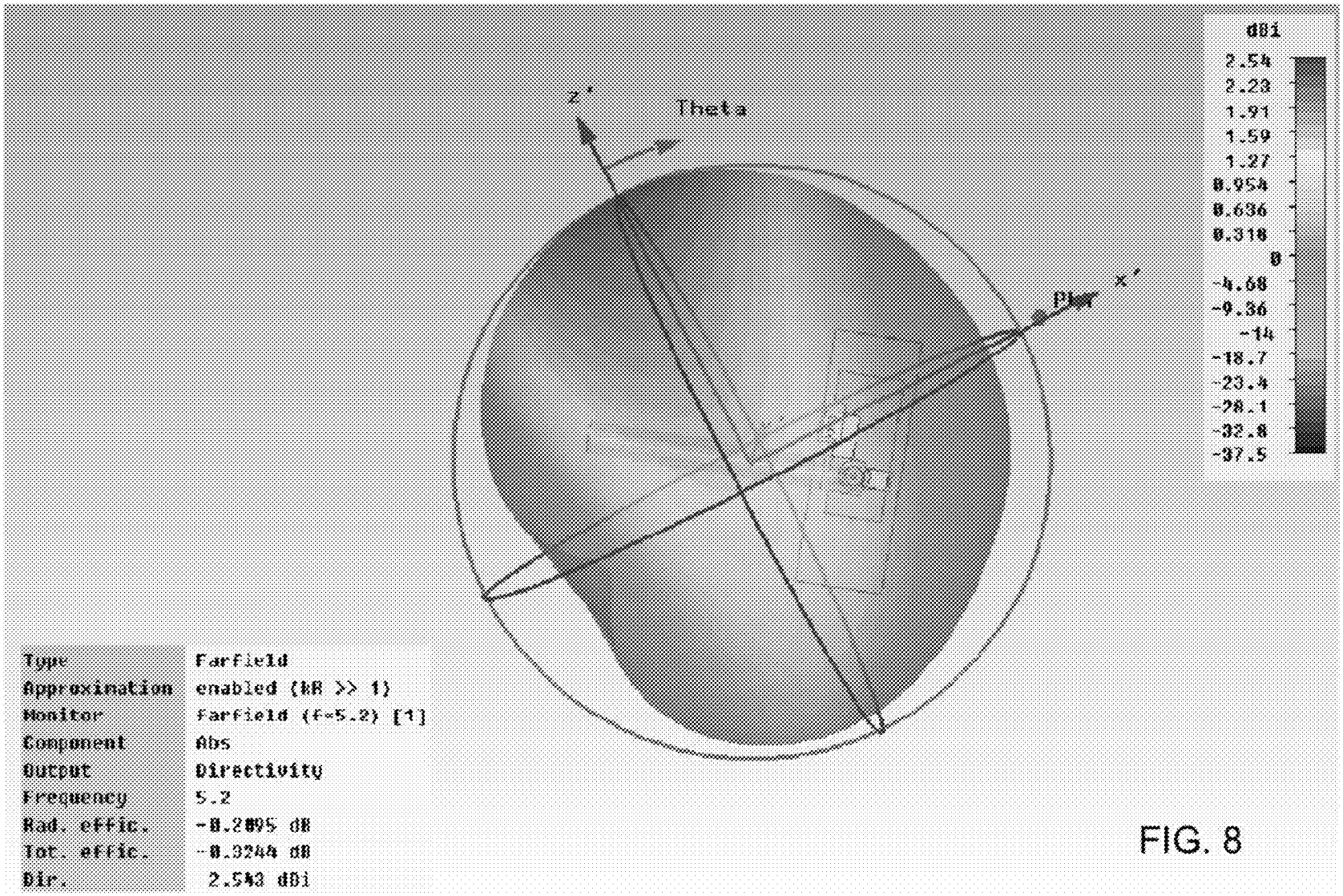
FIG. 8 provides an example of a 3D gain pattern for the antenna shown in FIGS. 1-3 & 5-7.
Figure 9:
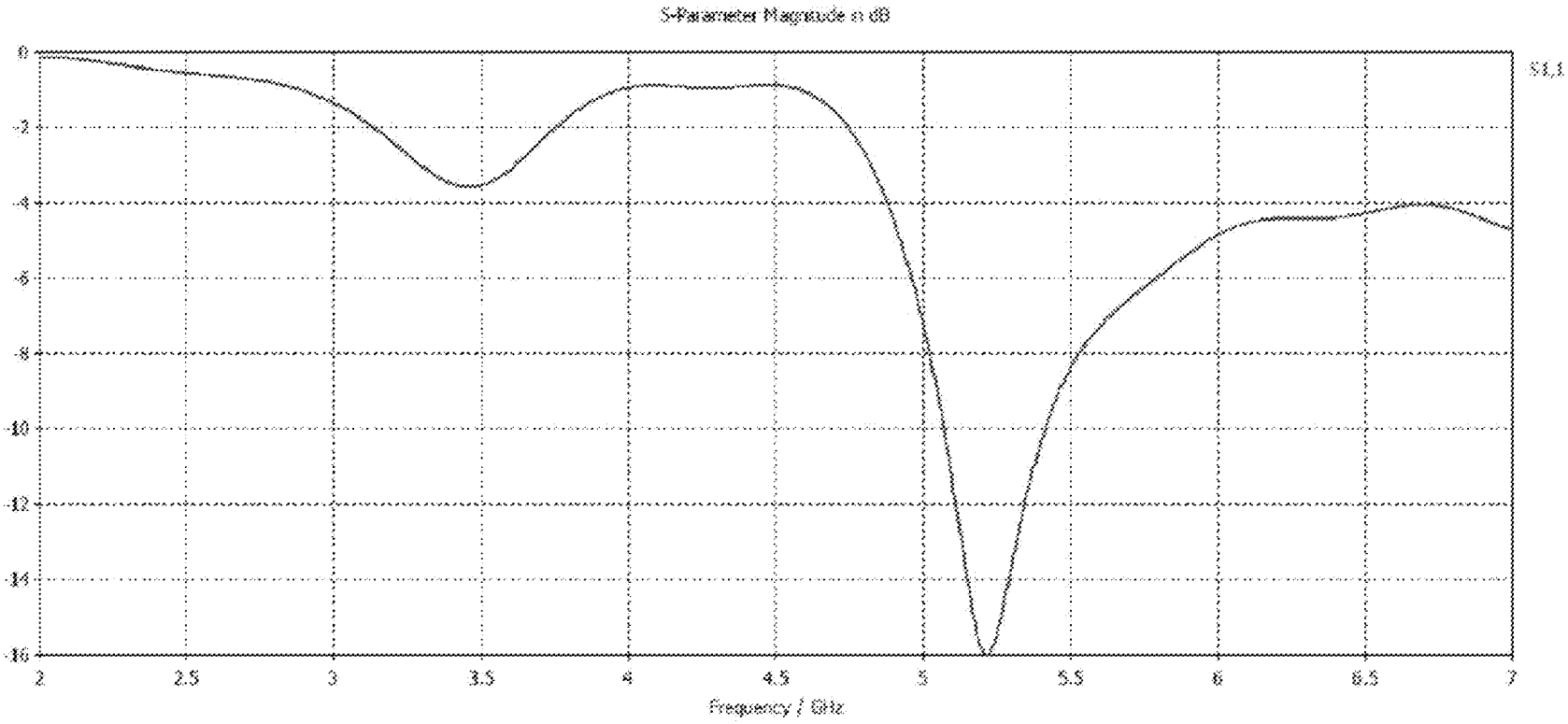
FIG. 9 provides an example of return loss performance for the antenna shown in FIGS. 1-3 & 5-7.

By way of example, the antenna 100 shown in FIGS. 1-3 & 5-7 has been constructed in a form factor having a width of about seven millimeters (7 mm) and a length of about 20 mm. In such a form factor, and with a copper planar conducting element 108 configured as shown in FIGS. 1-3 & 5-7, the planar conducting element 108 resonates in a range of frequencies extending from about 5.1 Gigahertz (GHz) to 5.9 GHz. Such an antenna is therefore capable of operating as a 5 GHz IEEE 802.11n or IEEE 802.11ac antenna. FIG. 8 provides an example of a 3D gain pattern for such an antenna, and FIG. 9 provides an example of return loss performance for such an antenna.

Figure 10:
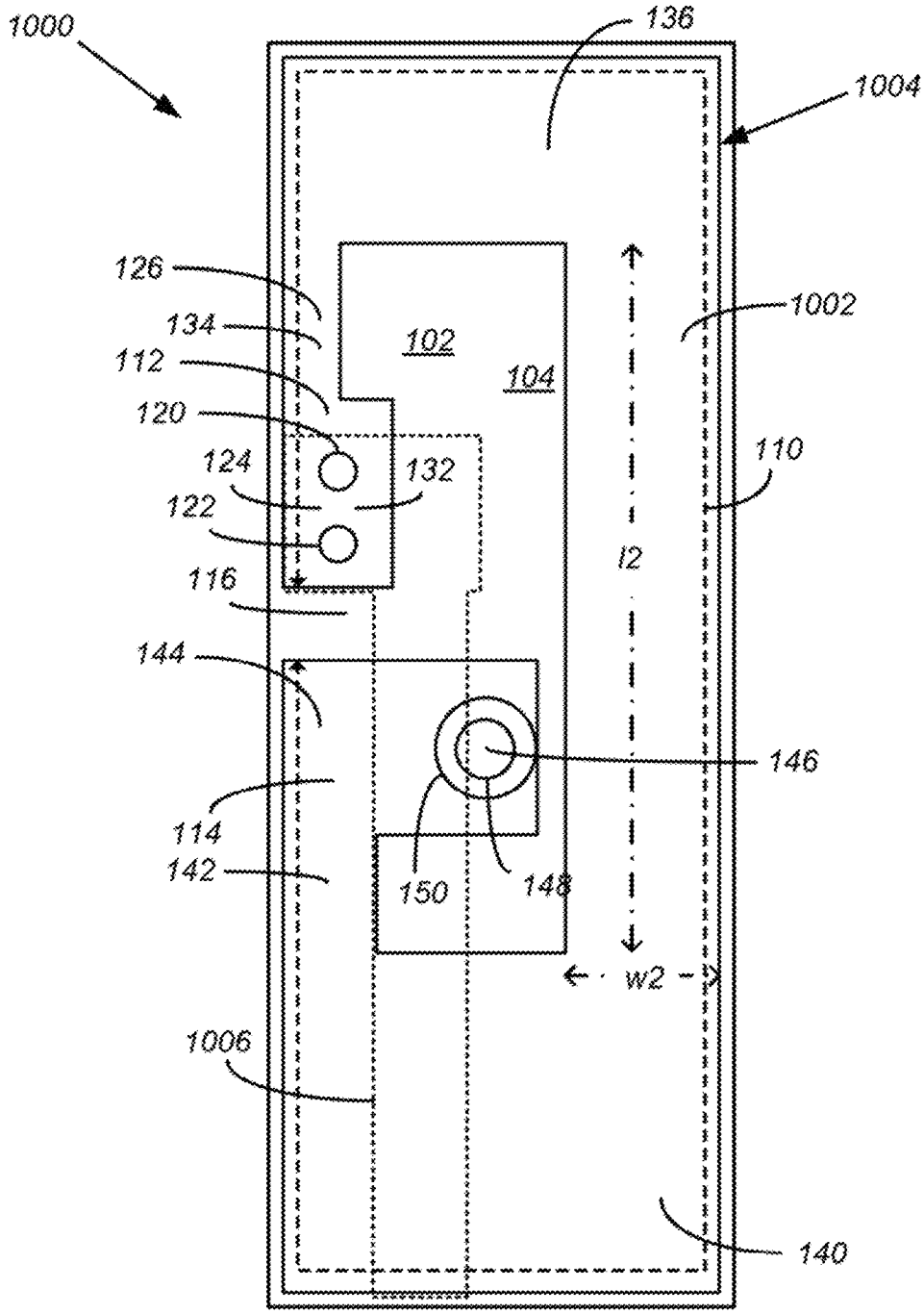
FIGS. 10 & 11 illustrate a second exemplary embodiment of an antenna having a planar conducting element, wherein the planar conducting element has a segment with greater width than the similarly situated segment shown in FIGS. 1 & 2.
Figure 11:
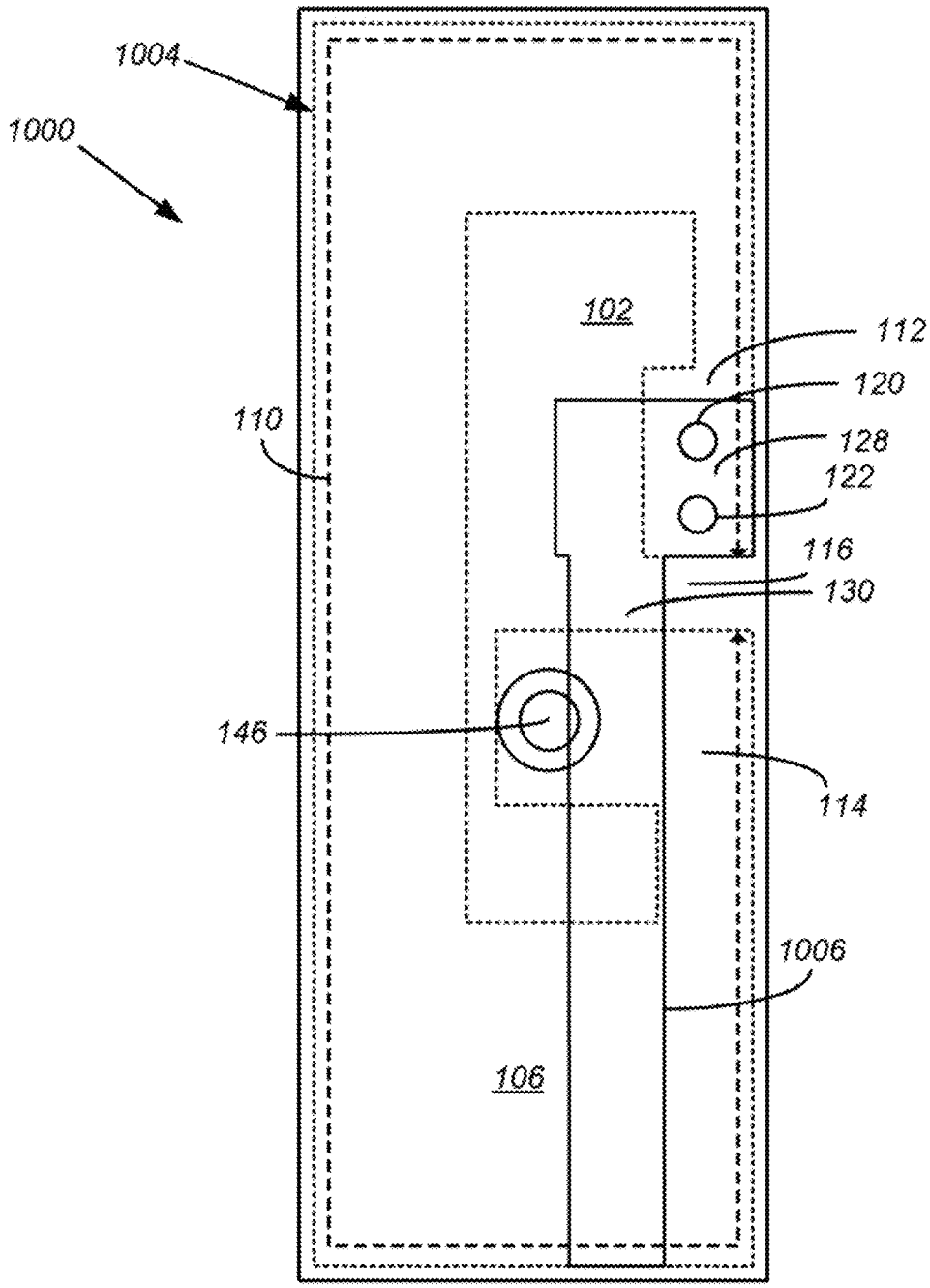
Figure 12:
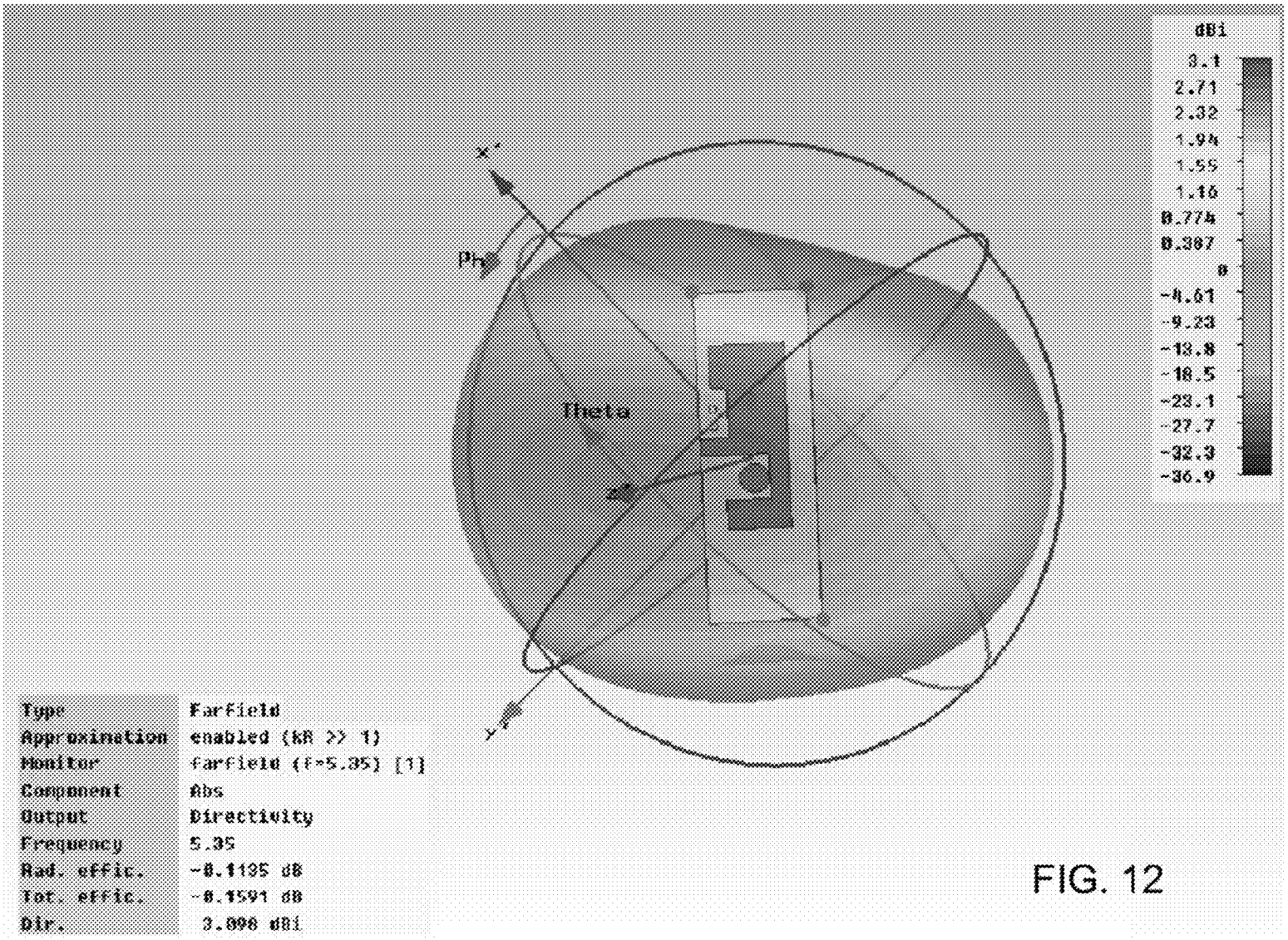
FIG. 12 provides an example of a 3D gain pattern for the antenna shown in FIGS. 10 & 11.
Figure 13:
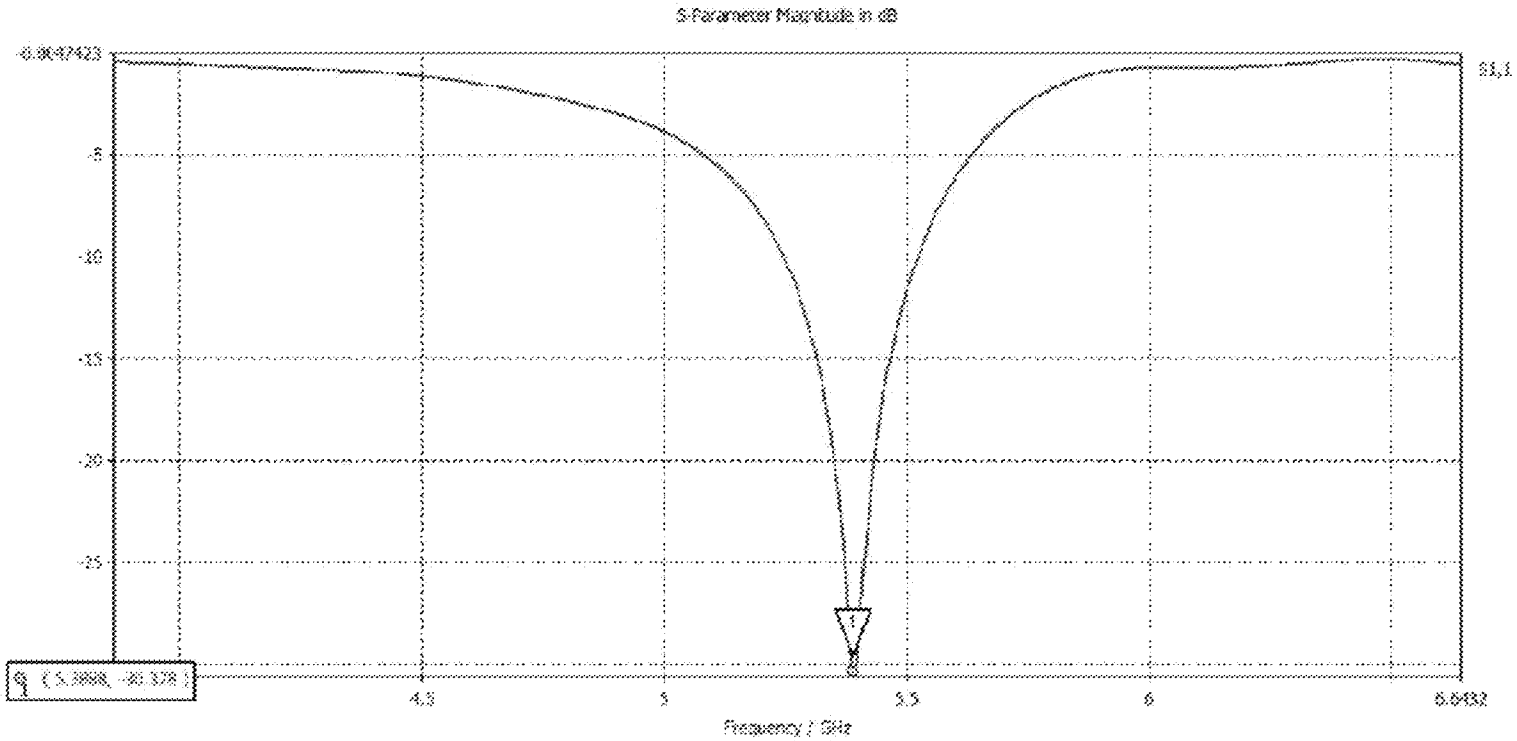
FIG. 13 provides an example of return loss performance for the antenna shown in FIGS. 10 & 11.

FIGS. 10 & 11 illustrate a second exemplary embodiment of an antenna (i.e., an antenna 1000). The elements found in antenna 1000 are the same as or similar to those found in antenna 100, but for the segment 1002 of the planar conducting element 1004 (FIG. 10) having a greater width, w2, than the similarly situated segment 138 of the planar conducting element 108 (FIG. 1), and but for the microstrip feed line 1006 having a different route (i.e., a route that exits the antenna's footprint over a short side of the planar conducting element 1004 verses a long side of the planar conducting element 108). The wider segment 1004 increases the azimuth of the antenna 1000 over the azimuth of the antenna 100. The different route of the microstrip feed line 1006 lowers the elevation of the antenna 1000 when compared to the elevation of the antenna 100. FIG. 12 provides an example of a 3D gain pattern for the antenna 1000, and FIG. 13 provides an example of return loss for the antenna 1000.

The antenna 100 shown in FIGS. 1-3 & 5-7 may be modified in various ways for various purposes. For example, and as already noted, the dimensions and shapes of the planar conducting element's segments 132-144 may be changed. Longer segments typically provide for lower frequency. operation. A wider segment opposite the non-conductive gap typically increases the gain of the antenna's azimuth. Changing the length or width of one of the top or bottom segments 336, 340 tends to change the center frequency and bandwidth of the antenna. Changing the point at which the microstrip feed line 118 leaves the footprint defined by the planar conducting element 108 and non-conductive gap 116 tends to change the elevation pattern of the antenna 100. The number of segments that define the planar conducting element 108 may also be changed.

Figure 14:
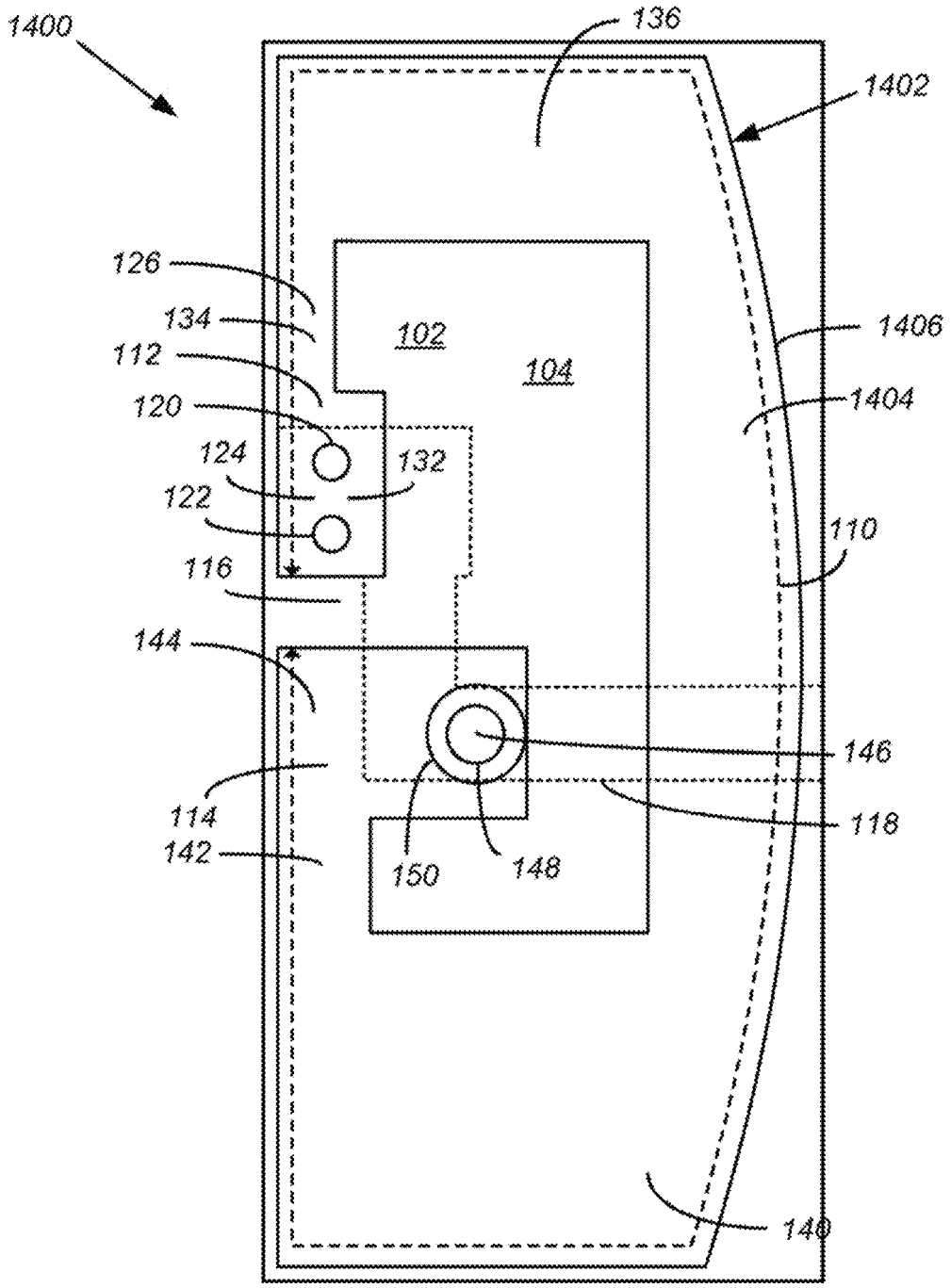
FIG. 14 illustrates a third exemplary embodiment of an antenna having a planar conducting element, wherein the planar conducting element has a segment with a curved edge.

In some cases, one or more segments of the planar conducting element may be provided with a curved edge. For example, FIG. 14 illustrates an antenna 1400 that is similar to the antenna 100, but for the segment 1404 of the planar conducting element 1402 having a curved outer edge 1406. The curved outer edge 1406 gives the footprint of the planar conducting element 1402 and non-conductive gap 116 a curve. Additional segments of the planar conducting element 1402 could also be provided with curved outer edges. The segments 132-136, 1404, 140-144 may also be provided with curved inner edges. By providing adjacent ones of a planar conducting element's segments 132-136, 1404, 140-144 with curved inner or outer edges, changes in the planar conducting element's width may be made in a continuous verses discrete fashion.

In some embodiments, the through-hole 146 in the antenna 100 (FIG. 1) may have a different size or location or may intersect the planar conducting element 108 without forming a hole in the planar conducting element 108. The through-hole 146 may also be positioned such that it does not intersect the planar conducting element 108.

In some embodiments, the plurality of conductive vias 120, 122 shown in FIGS. 1, 2, 5 & 6 may comprise more or fewer vias; and in some cases, the plurality of conductive vias 120, 122 may consist of only one conductive via. Despite the number of conductive vias 120, 122 provided, each of the conductive vias 120, 122 may be electrically connected to the electrical microstrip feed line 118 (or to a conductive pad at which the microstrip feed line 118 terminates).

Figure 15:
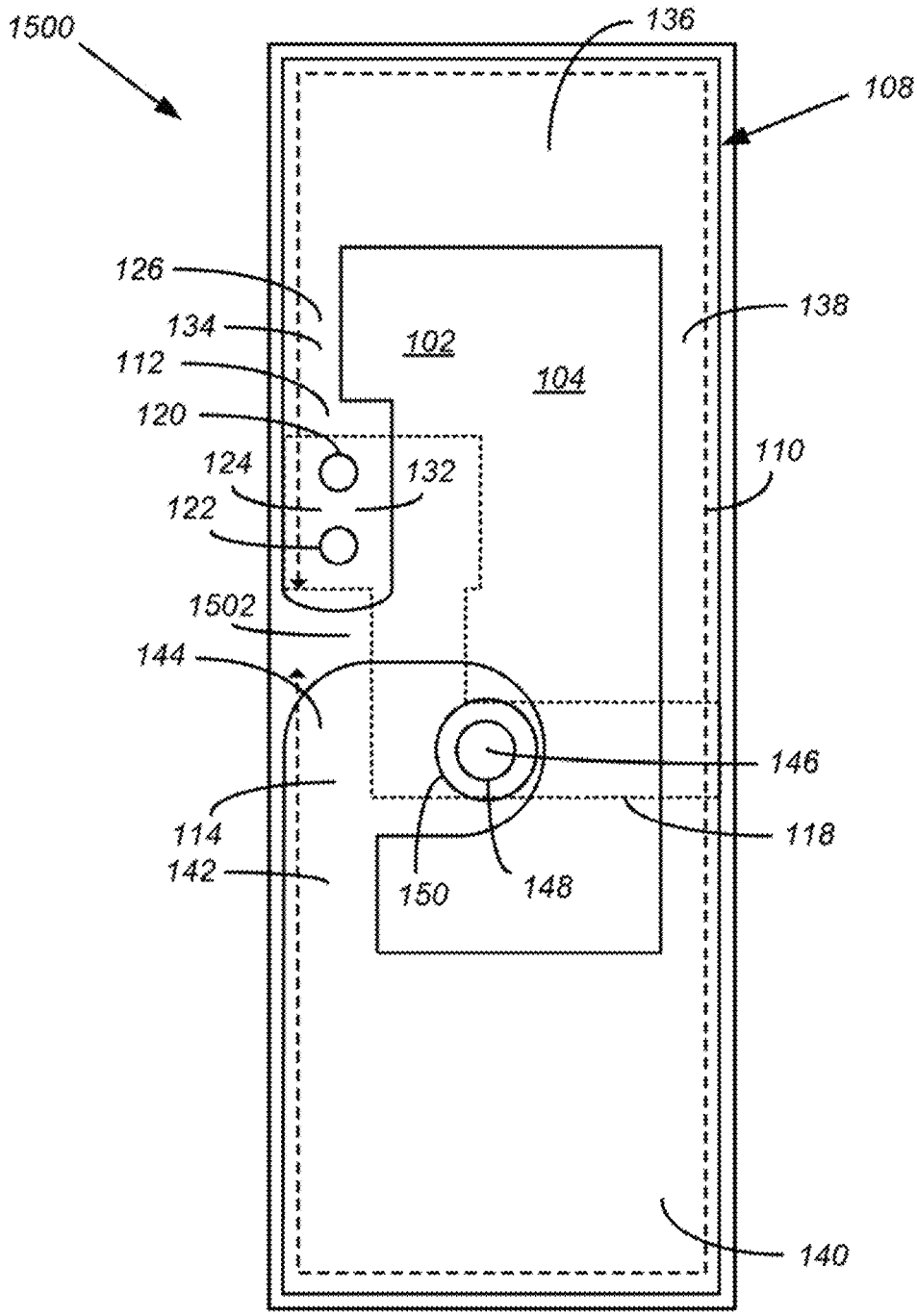
FIG. 15 illustrates a fourth exemplary embodiment of an antenna having a planar conducting element, wherein first and second end portions of the antenna are separated by a differently shaped non-conductive gap.

In FIGS. 1, 2, 5 & 6, and by way of example, the non-conductive gap 116 between the first and second end portions 112, 114 is shown to be rectangular and of uniform width. Alternately, the gap 116 could have other configurations, such as the curved configuration 1502 shown in the antenna embodiment 1500 of FIG. 15. As an aside, it is noted that FIG. 15 extends the curved edge of segment 144 around three sides of the through-hole 146. The non-conductive gap 116 could also be moved to other locations along a long edge of the planar conducting element 108, or to a short edge of the planar conducting element 108, or to a corner of the planar conducting element.

In some embodiments, the footprint of a planar conducting element and non-conductive gap may define a quadrilateral other than a rectangle, such as a square or diamond. Alternately, the footprint could define a circle, oval, trapezoid, or more abstract shape.

Figure 16:
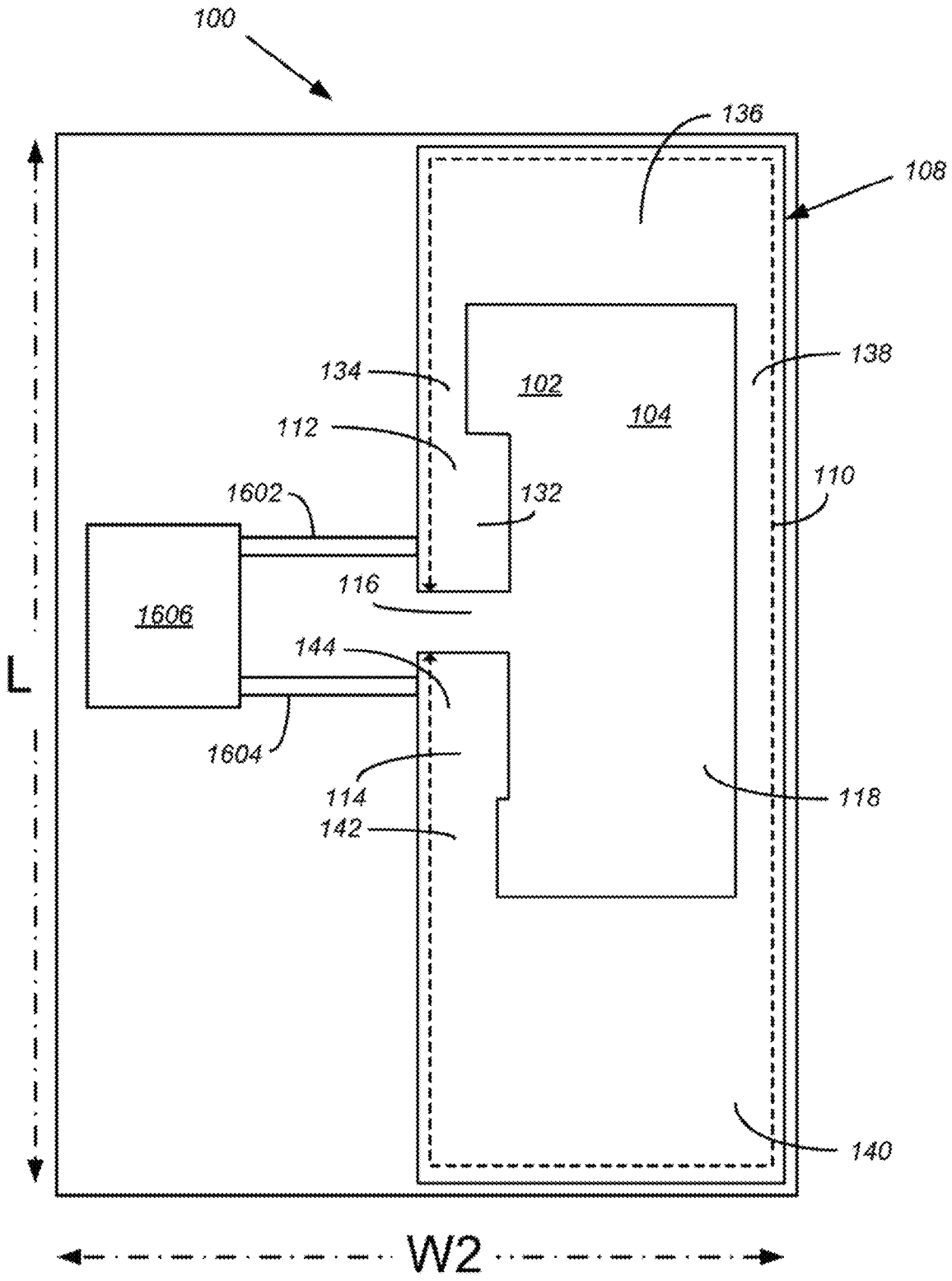
FIG. 16 illustrates a variation of the antenna shown in FIG. 1, wherein the antenna's through-hole and conductive vias have been eliminated and the antenna's dielectric material has been widened to route the antenna's microstrip feed line on the same side of the antenna as the planar conducting element.

FIG. 16 illustrates a variation 1600 of the antenna 100 (FIGS. 1-3 & 5-7), wherein the through-hole 146, conductive vias 120, 122 and coax cable 400 have been eliminated and the width, W2, of the dielectric material 102 has been increased. In this embodiment, a microstrip feed line or stripline 1602 is formed or mounted on the same side of the dielectric material 102 as the planar conducting element 108, and is electrically connected to the first end portion 112 of the planar conducting element 108 on the same side of the dielectric material 102 as the planar conducting element 108. Another microstrip feed line or stripline 1604 may be formed or mounted on the same side of the dielectric material 102 and electrically connected to the second end portion 114 of the planar conducting element. Each of the microstrip feed lines or striplines 1602, 1604 may also be electrically connected to a radio 1606. In alternate embodiments, one or both of the microstrip feed lines or striplines 1602, 1604 may be moved to the opposite side 106 of the dielectric material. The radio 1606 may also be moved to the opposite side 106 of the dielectric material. In yet further embodiments, one or both of the electrical connections to the radio 1606 may be made via a coax cable or other conductor(s). The radio 1606 may comprise an integrated circuit.

In some embodiments, a coax cable can also be connected to the planar conducting element 108 on one side of the dielectric material 102. For example, the center conductor of a coax cable could be electrically connected (e.g., soldered) directly to the first end portion 112 of the planar conducting element, and the sheath of the coax cable could be electrically connected (e.g., soldered) directly to the second end portion 114 of the planar conducting element 108.

Although the drawings show microstrip feed lines and coax cables that intersect the footprint of a planar conducting element substantially at a right angle, a feed line could alternately intersect the footprint of the planar conducting element and non-conductive gap at an angle other than ninety degrees (90°).

Figure 17:
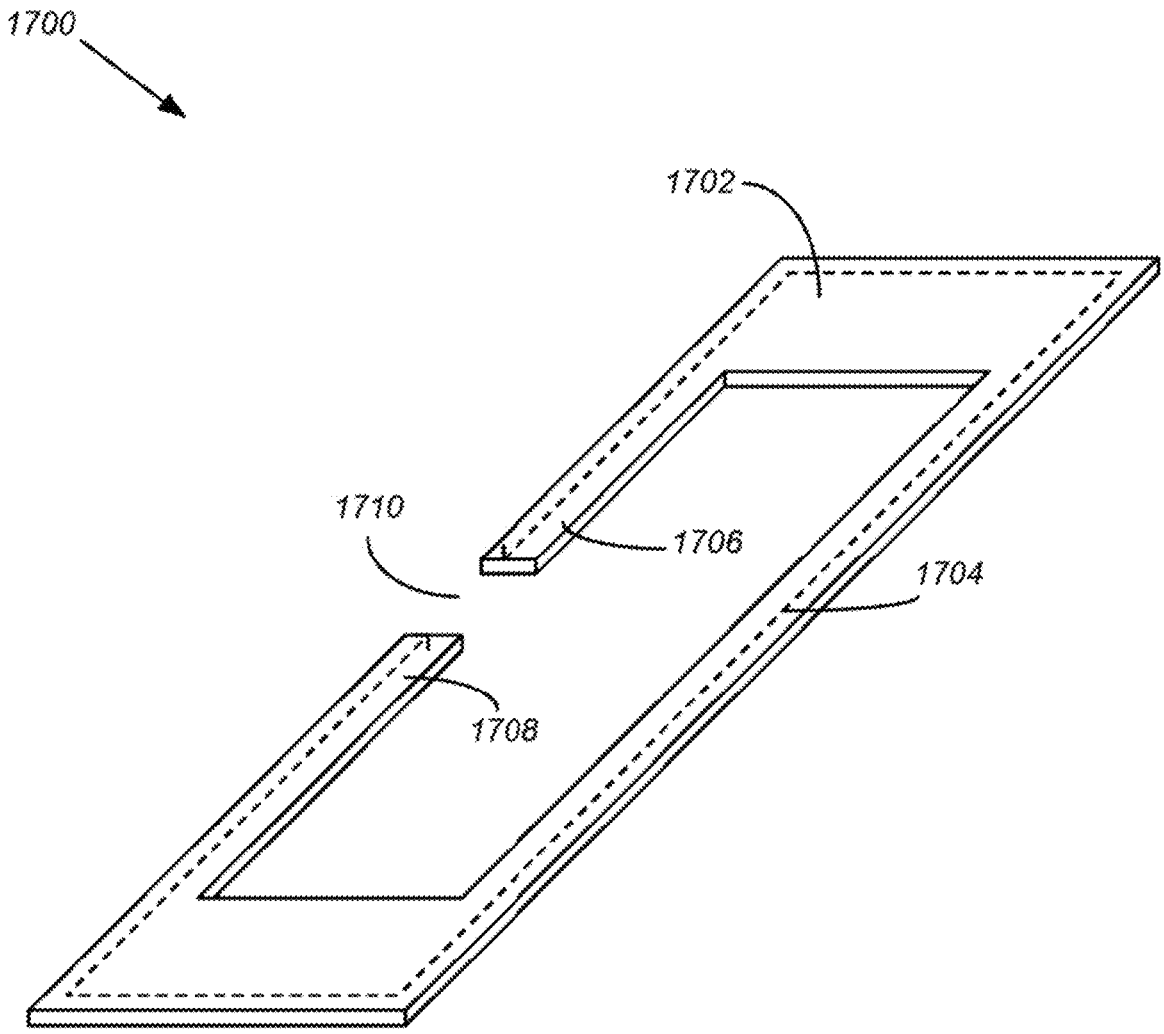
FIG. 17 illustrates a fifth exemplary embodiment of an antenna having a planar conducting element, wherein the planar conducting element is not mounted to a dielectric material.

One of the unique aspects of the antenna 100 (FIG. 1) is its tunability, which is provided in part by an ability to vary the width of the planar conducting element 108 along the length of the conductive path 110. FIG. 17 illustrates another way to achieve this sort of tenability. The antenna 1700 comprises a planar conducting element 1702. The planar conducting element 1702 defines a conductive path 1704 between first and second end portions 1706, 1708 of the planar conducting element 1702. The planar conducting element 1702 has at least two different widths (W1 and W2) transverse to the conductive path 1704. The first and second end portions 1706, 1708 of the planar conducting element 1702 are separated by a non-conductive gap 1710.

The antenna 1700 differs from the antenna 100 in that it does not include a dielectric material. Instead, the antenna 1700 may extend in free space, supported only by a coax cable, connector(s) or other element(s) connected to its first and second end portions 1706, 1708. Alternately, the planar conducting element 1702 may be supported by one or more non-conductive supports, or may be laid on a non-conductive surface.

The planar conducting element 1702 may comprise, for example, a plurality of conductive bars, at least two of which have different widths, or at least one of which has a varying width. The planar conducting element 1702 may also comprise, for example, a plurality of wires, at least two of which have different diameters. The conductive bars, wires or other elements that form the planar conducting element 1702 may be welded, soldered, adhesively bonded, or otherwise conductively joined to form the planar conducting element 1702. Still further, and as shown in FIG. 17, the planar conducting element 1702 may be cut or stamped from a single sheet of metal, such as aluminum, copper or steel. In this embodiment, the planar conducting element 1702 may be formed to mimic a plurality of individual segments. Alternately, the inside and outside edges of the planar conducting element 1702 could be curved along the sections where its width varies, thereby making the identification of different segments somewhat arbitrary (if possible at all).

Similarly to the antenna 100, and variants thereof, the footprint defined by the planar conducting element 1702 and non-conductive gap 1710 defines a rectangle having the non-conductive gap 1710 on one side. Alternately, the planar conducting element and non-conductive gap could be reconfigured to define a footprint having another shape.

For purposes of this disclosure, a conducting element is considered "planar" if there exists an imaginary plane that intersects the conducting element at a continuum of points between the planar conducting element's first end portion and second end portion.

Applications in which antennas such as those described herein are useful include, but are not limited to, the following: mobile phones, mobile computers (e.g., laptop, notebook, tablet and netbook computers), electronic-book (e-book) readers, personal digital assistants, wireless routers, and other wireless or mobile devices.

What is claimed is:

1. An antenna, comprising:

a dielectric material having a first side opposite a second side;

a planar conducting element on the first side of the dielectric material, wherein the planar conducting element defines a conductive path between first and second end portions of the planar conducting element, and wherein the first and second end portions of the planar conducting element are separated by a non-conductive gap;

a conductive via in the dielectric material, the conductive via electrically connected to the first end portion of the planar conducting element; and an electrical microstrip feed line on the second side of the dielectric material, the electrical microstrip feed line electrically connected to the conductive via.

2. The antenna of claim 1, wherein the dielectric material defines at least part of a through-hole in the antenna, the through-hole being at or near the second end portion of the planar conducting element.

3. The antenna of claim 2, further comprising a coax cable having a center conductor, a conductive sheath, and a dielectric separating the center conductor from the conductive sheath, wherein the center conductor extends through the through-hole, wherein the center conductor is electrically connected to the electrical microstrip feed line, and wherein the conductive sheath is electrically connected to the second end portion of the planar conducting element.

4. The antenna of claim 2, wherein the through-hole extends through the planar conducting element.

5. The antenna of claim 1, wherein the electrical microstrip feed line has a route extending from the conductive via, to across the non-conductive gap, to under the second end portion of the planar conducting element.

* * * * *